US007867607B2

(12) United States Patent
Park et al.

(10) Patent No.: US 7,867,607 B2
(45) Date of Patent: Jan. 11, 2011

(54) POLYOLEFIN FIBER AND METHOD OF PRODUCING THE SAME

(75) Inventors: Pyung-Youl Park, Gimcheon-si (KR); Dong-Hun Kwak, Daegu (KR)

(73) Assignee: Kolonglotech, Inc., Gwacheon (KR)

( * ) Notice: Subject to any disclaimer, the term of this patent is extended or adjusted under 35 U.S.C. 154(b) by 292 days.

(21) Appl. No.: 11/951,180

(22) Filed: Dec. 5, 2007

(65) Prior Publication Data

US 2009/0093180 A1 Apr. 9, 2009

(30) Foreign Application Priority Data

Oct. 5, 2007 (KR) ..... 10-2007-0100204

(51) Int. Cl.
*B32B 25/02* (2006.01)

(52) U.S. Cl. ..... 428/296.7; 264/164; 264/171.11

(58) Field of Classification Search ..... 428/296.7
See application file for complete search history.

(56) References Cited

U.S. PATENT DOCUMENTS 6,177,191 B1 * 1/2001 Gupta et al. ..... 428/364
2004/0043209 A1 * 3/2004 Schnurer et al. ..... 428/327
2007/0167549 A1 * 7/2007 Bornemann et al. ..... 524/318

* cited by examiner

*Primary Examiner*—Lynda Salvatore

(57) ABSTRACT

A polyolefin fiber includes 0.2 to 5.0 wt % of hydrophilic additive, and 0.05 to 3.00 wt % of titanium dioxide (TiO2). The polyolefin fiber may further include 0.2 to 1.0 wt % of spin finish provided on a surface thereof. The polyolefin fiber is spun to have a circular section, a modified cross-section including an X-shaped section, a Y-shaped section, a deltaic section, an oval section, a diamond section, a bladebone-shaped section, and a combined section thereof, or a combined section of the circular section and the modified cross-section. A method of producing a polyolefin fiber includes (a) melt extruding a composition which contains 93 to 99 wt % of polyolefin resin, 0.2 to 5.0 wt % of hydrophilic additive, and 0.05 to 3.00 wt % of any one titanium dioxide (TiO2) of rutile titanium dioxide, anatase titanium dioxide, and brookite titanium dioxide at 240 to 300° C. and performing winding at a spin speed of 500 to 2,000 mpm to produce a undrawn yarn, and (b) drawing the undrawn yarn at a draw ratio of 1.0 to 5.0, crimping the drawn yarn to 5.5 to 9.0 ea/cm by using a crimper, attaching 0.2 to 1.0 wt % of spin finish to a surface of the fiber by spraying or dipping, heat setting the spin finish at 100 to 130° C. for 3 to 10 min, and cutting the resulting polyolefin fiber to predetermined lengths.

17 Claims, No Drawings

POLYOLEFIN FIBER AND METHOD OF PRODUCING THE SAME

BACKGROUND OF THE INVENTION

1. Field of the Invention

The present invention relates to a polyolefin fiber and a method of producing the same. More particularly, the present invention pertains to a polyolefin fiber that includes a hydrophilic additive and titanium dioxide ($TiO_2$), and optionally a spin finish on a surface thereof and is spun to have a circular section, a modified cross-section such as an X-shaped section, a Y-shaped section, a deltaic section, an oval section, a diamond section, a bladebone-shaped section, and a combined section thereof, or a combined section of the circular section and the modified cross-section, and a method of producing the same.

2. Description of the Related Art

Polypropylene (PP) that is light, has excellent wear resistance, and is produced by using a relatively simple process at low cost is used for various purposes such as plastics, films, fibers and the like.

Known polypropylene is very limited in use due to poor thermal and ultraviolet stabilities and a difficulty in dyeing. However, the development of catalysts improves a polypropylene polymerization process and the development of additives such as thermal stabilizers and UV stabilizers and pigments contributes to coloration. Accordingly, polypropylene is widely used for such as interior materials for vehicles and interior carpets.

The polypropylene fiber has advantages of low specific gravity, high resistance to chemicals, and low price as compared to other natural or synthetic fibers. Thus, the polypropylene fiber is applied to various types of non-woven fabric products. In particular, the low melting point (about 165° C.) of polypropylene is suitable for a thermal bond non-woven fabric process combining fiber webs by heat and it is commercially used. The thermal bond non-woven fabrics made of the polypropylene fiber are used as coverstocks of disposable sanitary goods such as diapers and sanitary napkins.

Furthermore, the polypropylene fiber may be subjected to needle punching to produce felts for vehicle trims, carpets, civil engineering drain materials, oil absorption fabrics, and filter substrates, or to various types of spinning processes to produce cotton yarns for cloths and filters.

Many studies have been made to develop a process for providing hydrophilicity to the polypropylene fiber along with a process for providing dyeability. However, in most studies, desirable processes were not obtained and it was difficult to produce fibers due to compatibility to polypropylene.

The polypropylene fiber that consists of only carbon and hydrogen atoms has very strong hydrophobicity, thus having limited use. Processes for providing hydrophilicity to hydrophobic polyolefin (for example, polyethylene, polypropylene or the like) fibers will be described below. JP-A-2-169774 discloses a method of attaching a hydrophilic surfactant such as polyester denatured silicon and sorbitan fatty acid ester to the surfaces of hydrophobic fibers. However, in the method, the initial hydrophilicity is excellent but it is maintained only over a short period of time, and the hydrophilic surfactant is removed by water during treatment of spunlaces, so that hydrophobicity of polypropylene is increased. WO 2000/0071789 discloses a method of melt mixing fatty acid monoglyceride that contains 80 wt % or more of glyceride and has 8 to 16 carbon atoms and hydrophobic fibers to produce polyolefin fibers. However, the method is disadvantageous in that fast surface migration of fatty acid monoglyceride reduces maintenance time of hydrophilicity and it is difficult to perform a master batch process and to perform mixing in respects to polyolefin resins due to liquid surfactants. JP-A-2-221448 discloses hydrophilic non-woven fabrics that are made of complex fibers containing 3 to 13 wt % of fatty acid monoglyceride having 12 or more carbon atoms and 3 to 15 wt % of polyvinyl alcohol or polyamide. However, in the complex fibers, fatty acid monoglyceride and polyvinyl alcohol or polyamide are contained in a very large amount. Accordingly, production cost thereof is high. Furthermore, since the fibers are applied to only complex spinning devices, the type of production devices is limited.

Meanwhile, the development of appropriate spin finishes and the advance of finishing technologies realize provision of hydrophilicity once or several times and improve the quality of coverstocks such as disposable diapers, sanitary napkins or the like. However, even though hydrophilicity is provided to the polypropylene fibers by spin finish treatment, the fibers are applied to only disposable goods, not semi-durable goods and durable goods having desirable maintenance of hydrophilicity due to poor maintenance of hydrophilicity. Furthermore, the fibers cannot be used for sanitary and industrial wipe goods that are produced by using a spunlace process. The reason is as follows. High pressure jet water is used as a medium during entanglement of webs, which removes the spin finishes applied on the fiber surface to get back to hydrophilicity, so that polypropylene has strong hydrophobicity.

SUMMARY OF THE INVENTION

Therefore, the present invention has been made keeping in mind the above disadvantages occurring in the related arts, and an object of the present invention is to provide a polyolefin fiber having desirable maintenance of hydrophilicity and whiteness and low foaming property and excellent carding workability required to produce non-woven fabrics.

Another object of the present invention is to provide a polyolefin fiber that is capable of improving clearness of point and embossing patterns during thermal point bonding or thermal embossing processes.

Still another object of the present invention is to provide a method of producing a polyolefin fiber at a significantly improved yield.

DESCRIPTION OF THE PREFERRED EMBODIMENTS

The present invention provides a polyolefin fiber that includes 0.2 to 5.0 wt % of hydrophilic additive, and 0.05 to 3.00 wt % of titanium dioxide ($TiO_2$). The polyolefin fiber may further include 0.2 to 1.0 wt % of spin finish provided on a surface thereof. The polyolefin fiber is spun to have a circular section, a modified cross-section including an X-shaped section, a Y-shaped section, a deltaic section, an oval section, a diamond section, a bladebone-shaped section, and a combined section thereof, or a combined section of the circular section and the modified cross-section.

Hydrophilic Additive

The hydrophilic additive is used to provide desirable hydrophilic durability (maintenance of hydrophilicity) while physical properties of the polyolefin (particularly, polypropylene) fiber, spinnability, and stretchability are maintained. The amount of hydrophilic additive must be 0.2 wt % or more in order to continuously ensure desirable hydrophilicity, and 5.0 wt % or less in order to prevent physical properties, spinnability, and stretchability of the polypropylene fiber from being deteriorated.

The optimum amount of hydrophilic additive depends on the thickness of the final fiber. Since the thin fiber has larger specific surface area than that of the thick fiber, the amount of the hydrophilic additive should be increased as the thickness of the fiber is reduced.

Preferably, the hydrophilic additive includes monoglycerine fatty acid ester containing monoglyceride, which is represented by Formula 1, and polyglycerine fatty acid ester containing monoglyceride, which is represented by Formula 2, at a mixing ratio of 10:90 to 90:10:

[Formula 1]

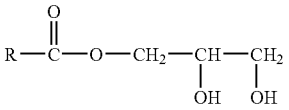

[Formula 2]

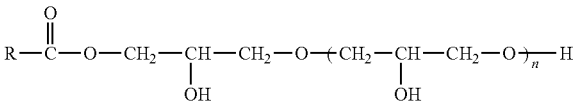

wherein, R is each independently saturated or unsaturated hydrocarbon having 10 to 18 carbon atoms and n is an integer in the range of 1 to 9.

When monoglycerine fatty acid ester is melted and mixed with the polypropylene fiber, surface migration is relatively quick as compared to polyglycerine fatty acid ester, which significantly affects initial hydrophilicity of the fiber. Therefore, if amount (wt %) of monoglycerine fatty acid ester is 10 or more, the polypropylene fiber has the desirable initial hydrophilicity, and if amount (wt %) of polyglycerine fatty acid ester is 10 or more, the hydrophilicity of the polypropylene fiber is desirably maintained.

In glycerine fatty acid ester that is contained in the hydrophilic additive of the present invention, glycerol combined with only one fatty acid is referred to as "monoglyceride". The purity of monoglycerine fatty acid ester may be shown as an amount (wt %) of monoglyceride represented by the above-mentioned Formula 1, and the purity of polyglycerine fatty acid ester may be shown as an amount (wt %) of monoglyceride represented by the above-mentioned Formula 2. The hydrophilicity of the polypropylene fiber is increased as the amount of monoglyceride, which is represented by the above-mentioned Formula 1, in monoglycerine fatty acid ester is increased. The maintenance of hydrophilicity is improved as the amount of monoglyceride, which is represented by the above-mentioned Formula 2, in polyglycerine fatty acid ester is increased. Therefore, in order to ensure the desirable hydrophilicity and desirably maintain the hydrophilicity, the amount of monoglyceride of monoglycerine fatty acid ester is preferably 80 to 100 wt % and more preferably 90 to 100 wt % and the amount of monoglyceride of polyglycerine fatty acid ester is preferably 40 to 100 wt % and more preferably 90 to 100 wt %.

Preferably, the monoglycerin fatty acid ester is one or more selected from the group consisting of glycerine monocaprate, glycerine monolaurate, glycerin monomyristate, glycerin monopalmitate, glycerin monostearate, and glycerin monooleate, and the polyglycerine fatty acid ester is one or more selected from the group consisting of diglycerin monocaprate, diglycerin monolaurate, diglycerin monomyristate, diglycerin monopalmitate, diglycerin monostearate, and diglycerin monoolate.

The hydrophilicity of the hydrophilic polyolefin resin (fiber) is increased as the degree of polymerization n of polyglycerine fatty acid ester is increased and the number of carbon atoms of R of the fatty acid is decreased. However, if R has a small number of carbon atoms, the persistency of hydrophilicity is undesirably declined.

Titanium Dioxide

Titanium dioxide ($TiO_2$) improves whiteness to increase the quality of fiber used as sanitary goods. If the hydrophilic additive is added in an amount of 3.0 wt % or more, 0.05 to 3.00 wt % of titanium dioxide may be added to prevent carding workability from being reduced. If the amount of titanium dioxide is less than 0.05 wt %, the whiteness is insignificantly improved and it is difficult to desirably improve carding workability. If the amount of titanium dioxide is more than 3.0 wt %, the spinning workability is poor.

In addition, titanium dioxide can improve clearness of point and embossing patterns during thermal point bonding or thermal embossing processes when or after non-woven fabrics (particularly, spunlace non-woven fabrics) are produced by using the hydrophilic polyolefin (particularly, polypropylene) fiber (penetration of light is significantly reduced in point and embossing patterns thermally pressed as compared to the other portions to cause opacity and whiteness, thus improving clearness of the point and embossing patterns).

In consideration of dispersion of titanium dioxide particles in the polyolefin (particularly, polypropylene) fiber and the spinnability of the fiber, it is preferable that an average particle size of titanium dioxide be 0.4 μm or less. If the particle size of titanium dioxide is more than 0.4 μm, the spinning workability may be poor. Titanium dioxide may be selected from rutile titanium dioxide, anatase titanium dioxide, or brookite titanium dioxide. In order to minimize abrasion of production devices and maximize a photocatalytic effect, it is more preferable to use anatase titanium dioxide having relatively low hardness and high redox power.

Spin Finish

The polyolefin fiber of the present invention may further include spin finishes on a surface thereof. It is required that the polyolefin (particularly, polypropylene) fiber, which is used to produce the non-woven fabrics (particularly, spunlace non-woven fabrics), has the fiber-to-fiber/fiber-to-metal friction and antistatic property suitable to a carding process and generation of bubbles is minimized during a hydro-entangling (spunlace) process. Thus, it is preferable that the spin finish be attached or applied on the surface of the fiber in an amount of 0.2 to 1.0 wt %.

Preferably, the spin finish includes (i) 70 to 85 wt % of one or more non-ionic surfactants selected from the group consisting of polyethylene polypropylene glycol monobutyl ether, polyoxyethylene sorbitan trioleate, and polyoxyethylene ester oleate, (ii) 5 to 15 wt % of anion antistatic agents including polyoxyethylene alkyl phosphate which contains an alkyl group having 8 to 18 carbon atoms and of which phosphate is one or more selected from the group consisting of a sodium salt, a potassium salt, a triethylamine salt, and a monoethylamine salt, and (iii) 5 to 15 wt % of one or more non-silicon antifoaming agents selected from the group consisting of polyoxyalkylene glycol, poly(oxyethylene, oxypropylene) alkyl ether, poly(oxyethylene, oxypropylene) glycol copolymer, and polyoxyalkylene triol.

Other Additives

The polyolefin (particularly, polypropylene) resin may further contain one or more additives selected from the group consisting of an antioxidant, a UV stabilizer, a process stabilizer, and a coloring agent such as a pigment. The amount of the additive is contained in an amount of preferably 2 wt % or less and more preferably 0.1 to 1.5 wt % based on the polyolefin fiber.

The polyolefin fiber according to the present invention may be spun to have a circular section, a modified cross-section including an X-shaped section, a Y-shaped section, a deltaic section, an oval section, a diamond section, a bladebone-shaped section, and a combined section thereof, or a combined section of the circular section and the modified cross-section. In particular, the polyolefin fiber, which is spun to have the modified cross-section or a combined section of the circular section and the modified cross-section, has an improved liquid-absorptive capacity, wiping efficiency and strength of non-woven fabrics.

Furthermore, the present invention provides a method of producing a polyolefin fiber, which includes (a) melt extruding a composition which contains 93 to 99 wt % of polyolefin resin, 0.2 to 5.0 wt % of hydrophilic additive, and 0.05 to 3.00 wt % of any one titanium dioxide ($TiO_2$) of rutile titanium dioxide, anatase titanium dioxide, and brookite titanium dioxide at 240 to 300° C. and winding at a spin speed of 500 to 2,000 mpm to produce a undrawn yarn, and (b) drawing the undrawn yarn at a draw ratio of 1.0 to 5.0, crimping the drawn yarn to 5.5 to 9.0 ea/cm using a crimper, attaching 0.2 to 1.0 wt % of spin finish to a surface of the fiber by spraying or dipping, then heat setting the spin finish at 100 to 130° C. for 3 to 10 min, and cutting the resulting polyolefin fiber to predetermined lengths. The method is a two-step process comprising a series of the spinning and the drawing separately and a melt-extruded substance is slowly cooled by using cross-flow type quenching air. It is preferable that a flow rate of the cross-flow type quenching air be 1 to 4 m/sec.

Furthermore, the present invention provides a method of producing a polyolefin fiber, which includes melt extruding a composition which contains 93 to 99 wt % of polyolefin resin, 0.2 to 5.0 wt % of hydrophilic additive, and 0.05 to 3.00 wt % of any one titanium dioxide ($TiO_2$) of rutile titanium dioxide, anatase titanium dioxide, and brookite titanium dioxide at 230 to 270° C., winding at a spin speed of 40 to 300 mpm to produce an undrawn yarn, drawing the undrawn yarn at a draw ratio of 1.0 to 5.0, crimping the stretched yarn to 5.5 to 9.0 ea/cm by using a crimper, attaching 0.2 to 1.0 wt % of spin finish to a surface of the fiber by spraying or dipping, heat setting the spin finish at 100 to 130° C. for 3 to 10 min, and cutting the resulting polyolefin fiber to predetermined lengths. In the method, an one-step process including spinning and stretching continuously performed is used, and the fiber which is discharged while being spaced apart from a spinneret by a predetermined length is cooled by using in-out flow type cooling air. It is preferable that a flow rate of the in-out flow type cooling air be 10 to 50 m/sec.

The polyolefin fiber according to the present invention has desirable maintenance of hydrophilicity and whiteness even after rinsing. The polyolefin fiber also has low foaming property and excellent carding workability required to produce non-woven fabrics (particularly, spunlace non-woven fabrics). The polyolefin fiber improves clearness of point and embossing patterns during thermal point bonding or thermal embossing processes.

According to the method of producing the polyolefin fiber of the present invention, it is possible to improve the yield of the polyolefin fiber.

Hereinafter, embodiments of the present invention will be described in detail. The present invention may, however, be embodied in many different forms and should not be construed as being limited to the embodiments set forth herein. Rather, these embodiments are provided such that this disclosure will be thorough and complete and will fully convey the concept of the present invention to those skilled in the art.

EXAMPLE

Production of Compositions for Hydrophilic Polypropylene Fibers

Polypropylene resins, hydrophilic additives, and titanium dioxide ($TiO_2$) that were used as essential components of the composition for polypropylene fibers, and spin finishes as optional components are described in the following Tables 1-1, 1-2, 1-3, and 1-4.

TABLE 1-1

| Polypropylene resin | | |
|---|---|---|
| | A | B |
| Component | Polypropylene resin powder | Polypropylene resin powder |
| Melt index (MI) [g/10 min] | 17 | 25 |
| Density [g/cc] | 0.9 | 0.9 |
| Isotactic index [%] | 96 | 96 |
| Note | Antioxidant is contained (0.1 wt %) | Antioxidant is contained (0.1 wt %) |

TABLE 1-2

| Hydrophilic additive | | | | |
|---|---|---|---|---|
| | Main component | monoglyceride | Type | HLB |
| GMS | Glycerine monostearate | 90% | Powder | 4.1 |
| GML | Glycerine monolaurate | 40% | Paste | 7.5 |
| PG | Polyglyceride [glycerine mono/di/tri-stearate] | Monoglyceride: 40% Diglyceride: 30% Triglyceride: 30% | Powder | 3.7 |
| DGMO | Diglycerine monooleate | 40% | Liquid | 6.0 |

TABLE 1-3

| Titanium dioxide ($TiO_2$) | | | |
|---|---|---|---|
| | Component | Refractive index | Average particle size [μm] |
| C | Anatase titanium dioxide | 2.55 | 0.25 |
| D | Anatase titanium dioxide | 2.52 | 0.45 |

TABLE 1-4

| Spin finishes | | |
|---|---|---|
| | Composition | Note |
| E | Liquid mixture of 50 g of polyethylene polypropylene glycol monobutyl ether, 20 g of polyoxyethylene sorbitan trioleate, and 13 g of polyoxyethylene ester oleate used as a non-ionic surfactant, 7 g of polyoxyethylene stearyl phosphate triethanol aminate used as an anionic antistatic, and 10 g of polyoxyalkylene glycol polyalkylene glycol used as a non-silicon antifoaming agent | Hydrophilic spin finish having low foaming property |
| F | Liquid mixture of 40 g of polyoxyethylene lauryl ether, 20 g of polyethylene glycol monococoate, 15 g of polyoxyethylene alkyl phosphate, and 15 g of betaine type cationic surfactant | Hydrophilic emulsion |

The composition, which contained the polypropylene resin, the hydrophilic additive, and titanium dioxide ($TiO_2$) at the composition ratio shown in the following Table 2, was melted and extruded to perform pelletization.

TABLE 2

| | Poly-propylene | | | $TiO_2$ | | |
|---|---|---|---|---|---|---|
| Preparation example | Type | wt % | Hydrophylizing additive Type (mixing ratio) | wt % | Type | wt % |
| 1 | A | 100 | — | — | — | — |
| 2 | A | 99.5 | — | — | C | 0.5 |
| 3 | A | 99.5 | — | — | D | 0.5 |
| 4 | A | 99 | GMS | 1.0 | — | — |
| 5 | A | 99 | GML | 1.0 | — | — |
| 6 | A | 99 | PG | 1.0 | — | — |
| 7 | A | 99 | DGMO | 1.0 | — | — |
| 8 | A | 99 | GMS + PG (1:1) | 1.0 | — | — |
| 9 | A | 99 | GMS + DGMO (1:1) | 1.0 | — | — |
| 10 | A | 99 | GML + PG (1:1) | 1.0 | — | — |
| 11 | A | 99 | GML + DGMO (1:1) | 1.0 | — | — |
| 12 | A | 99 | GMS + GML + DGMO (1:1:1) | 1.0 | — | — |
| 13 | A | 97 | GMS | 3.0 | — | — |
| 14 | A | 97 | GML | 3.0 | — | — |
| 15 | A | 97 | GMS + DGMO (1:1) | 3.0 | — | — |
| 16 | A | 97 | GML + DGMO (1:1) | 3.0 | — | — |
| 17 | A | 97 | GMS + GML + DGMO (1:1:1) | 3.0 | — | — |
| 18 | A | 96.5 | GMS + GML + DGMO (1:1:1) | 3.0 | C | 0.5 |
| 19 | A | 96 | GMS + GML + DGMO (1:1:1) | 3.0 | C | 1.0 |
| 20 | A | 94 | GMS + GML + DGMO (1:1:1) | 3.0 | C | 3.0 |
| 21 | A | 94 | GMS + GML + DGMO (1:1:1) | 3.0 | D | 3.0 |
| 22 | A | 93 | GMS + GML + DGMO (1:1:1) | 3.0 | C | 4.0 |
| 23 | A | 95 | GMS + DGMO (1:1) | 5.0 | — | — |
| 24 | A | 95 | GML + DGMO (1:1) | 5.0 | — | — |
| 25 | A | 95 | GMS + GML + DGMO (1:1:1) | 5.0 | — | — |
| 26 | A | 94 | GMS + GML + DGMO (1:1:1) | 6.0 | — | — |

Production of Hydrophilic Polypropylene Fibers

The compositions of the above-mentioned Table 2 were spun under the spinning condition shown in the following Table 3 (spinning temperature and spinning speed) to produce an undrawn yarn of 2.5 denier. The undrawn yarn was drawn at a draw ratio of 2.2 and a preheating temperature of 60° C. and crimped to 5.5 to 9.0 ea/cm by using the crimper. 10.0 wt % of aqueous emulsion of spin finish E (see Table 1-4) was sprayed thereon to be attached to the surface of the fiber, so that the amount of spin finish was 0.35 wt % based on the total weight of the polypropylene fiber. The spin finish was subjected to heat setting at 120° C. and the resulting fiber was cut to lengths of 51 mm to produce a polypropylene fiber having the final fiber fineness of 1.5 denier.

The spinnability, the shape of the section, the tenacity, the fiber sinking time, the sinking time after the rinsing was performed one and two times, the foaming property, and the carding workability of the hydrophilic polypropylene fiber are shown in the following Table 3.

TABLE 3

Test data for the two-step process including spinning and drawing separately performed (spin speed: 1600 mpm)

| | | | | Physical properties of staple fiber | | | | | | | |
|---|---|---|---|---|---|---|---|---|---|---|---|
| Example | Spin temp. (° C.) | Spin speed [mpm] | Spin finish | Spinnability | Shape of cross-section | Tenacity [g/de] | Sinking time [sec] | Sinking time after washing is performed once [sec] | Sinking time after washing is performed twice [sec] | Foaming property [mm] | Carding workability |
| 1-1 | 260 | 1600 | E | ◎ | o | 3.08 | 9 | ∞ | ∞ | 0 | Good |
| 1-2 | 260 | 1600 | F | ◎ | o | 3.07 | 3 | ∞ | ∞ | 103 | Good |
| 2 | 260 | 1600 | E | ◎ | o | 3.10 | 8 | ∞ | ∞ | 0 | Good |
| 3 | 260 | 1600 | E | Δ | o | 3.02 | 9 | ∞ | ∞ | 0 | Middle |
| 4 | 260 | 1600 | E | ◎ | o | 3.07 | 11 | 50 | 185 | 0 | Good |
| 5 | 260 | 1600 | E | ◎ | o | 3.04 | 12 | 63 | 224 | 0 | Good |
| 6 | 260 | 1600 | E | ◎ | o | 3.05 | 11 | 15 min | 3 hr or more | 0 | Good |
| 7 | 260 | 1600 | E | ◎ | o | 3.10 | 10 | 80 | 92 | 0 | Good |
| 8 | 260 | 1600 | E | ◎ | o | 3.12 | 11 | 132 | 313 | 0 | Good |
| 9 | 260 | 1600 | E | ◎ | o | 3.07 | 10 | 42 | 49 | 0 | Good |
| 10 | 260 | 1600 | E | ◎ | o | 3.05 | 11 | 175 | 365 | 0 | Good |
| 11 | 260 | 1600 | E | ◎ | o | 3.10 | 10 | 49 | 54 | 0 | Good |
| 11 | 260 | 1600 | E | ◎ | o | 3.10 | 10 | 49 | 54 | 0 | Good |
| 12 | 260 | 1600 | E | ◎ | o | 3.08 | 10 | 35 | 43 | 0 | Good |
| 13 | 260 | 1600 | E | ◎ | o | 3.02 | 9 | 28 | 72 | 0 | Middle |
| 14 | 260 | 1600 | E | ◎ | o | 3.03 | 9 | 32 | 104 | 0 | Middle |
| 15 | 260 | 1600 | E | ◎ | o | 3.00 | 9 | 21 | 36 | 2 | Middle |
| 16 | 260 | 1600 | E | ◎ | o | 3.01 | 8 | 25 | 40 | 2 | Middle |
| 17 | 260 | 1600 | E | ◎ | o | 3.01 | 8 | 16 | 29 | 1 | Middle |
| 18 | 260 | 1600 | E | ◎ | o | 3.03 | 8 | 15 | 26 | 0 | Good |
| 19-1 | 260 | 1600 | E | ◎ | o | 3.04 | 8 | 14 | 27 | 1 | Good |
| 19-2 | 260 | 1600 | E | ◎ | Y | 3.00 | 10 | 16 | 29 | 1 | Good |
| 19-3 | 260 | 1600 | E | ◎ | X | 3.02 | 10 | 15 | 30 | 0 | Good |
| 19-4 | 270 | 1600 | E | ○ | o | 3.07 | 8 | 55 | 75 | 1 | Good |
| 19-5 | 280 | 1600 | F | Δ | o | 2.98 | 8 | 5 min | 8 min | 1 | Good |
| 19-6 | 290 | 1600 | E | × | o | — | — | — | — | — | — |
| 20 | 260 | 1600 | E | ○ | o | 3.04 | 7 | 15 | 23 | 1 | Good |
| 21 | 260 | 1600 | E | × | o | — | — | — | | — | — |
| 22 | 260 | 1600 | E | Δ | o | — | — | — | | — | — |
| 23 | 260 | 1600 | E | Δ | o | 2.86 | 8 | 14 | 18 | 4 | Poor |
| 24 | 260 | 1600 | E | Δ | o | 2.90 | 9 | 15 | 20 | 3 | Poor |
| 25 | 260 | 1600 | E | Δ | o | 2.92 | 7 | 10 | 16 | 3 | Poor |
| 26 | 260 | 1600 | E | × | o | — | — | — | | — | — |

The spinning temperature means the highest temperature immediately before the molten compositions were discharged through the spinneret. The spinnability was obtained by counting the number of yarn breaking and spinning dropping of the fiber under the spinneret. The spinnability was designated by ◎when the number of yarn cutting or spinning drop was less than 1 per unit time, ○ when the number of yarn cutting or spinning drop was in the range of 1 to 3 per unit time, Δ when the number of yarn cutting or spinning drop was more than 3 per unit time, and × when it was impossible to perform the spinning.

The fiber sinking time was obtained according to the ERT (EDANA RECOMMENDED TEST) 10.3-99 method, and the hydrophilicity was increased as the sinking time was reduced.

25 g of polypropylene fiber was put in the beaker containing 250 ml of deionized water at 75° C., heated in a double water bath for 20 min, dehydrated by using a centrifugal separator, completely dried in the oven at 120° C. for 30 min, and left under a standard condition for 2 hours to obtain the sinking time after the rinsing was performed once according to the ERT 10.3-99 method.

The rinsing, the dehydration, and the drying were performed by using the same procedure as the case of "the sinking time after the rinsing was performed once", the fiber was left under the standard condition for 1 day, and the measurement was repeated by using the same method as the case of "the sinking time after the rinsing was performed once" to obtain the sinking time after the rinsing was performed twice.

The foaming property of the hydrophilic polypropylene fiber is a physical property of the fiber that is a raw material used to produce the spunlace non-woven fabrics. If the foaming property is 2 mm or less, the foaming property is considered to be good. 25 g of polypropylene fiber was put in the beaker containing 250 ml of deionized water at 75° C., heated in a water bath for 7 min, and dehydrated. At this time, water, which was obtained during the dehydration of the fiber, was sampled in an amount of 10 ml, and strongly shook in a test tube for 5 sec. After 10 sec, the height of the bubbles was measured in an mm unit to obtain the foaming property.

Whether curling, fluttering, and static electricity occurs or not and whether the formation of webs is desirable or not were checked between card rolls while the fiber passes through the card machine to evaluate the carding workability. In case the webs were formed without curling, fluttering, and static electricity, the carding workability was considered to be good. When the curling, the fluttering, and the static electricity occurs and the webs are formed, the carding workability was considered to be in the middle. When it was impossible to form the webs, the carding workability was considered to be poor.

From the comparison of Example 1-1 to Example 1-2, it can be seen that the fiber of Example 1-2, which contains spin finish F, has a high foaming property. Thus, it is unsuitable for a raw material in the hydro-entangled (spunlace) non-woven fabric process. The reason is that in the spunlace non-woven fabric process where water is purified and recycled to be reused, if bubbles are formed, it is difficult to purify water and a flow of high pressure jet water that is discharged from the injector is changed.

From the comparison of Example 6 to Examples 4, 5, and 7, it can be seen that maintenance of hydrophilicity of the fiber containing monoglyceride is better than that of the fiber containing polyglyceride.

From the comparison of Examples 8 and 10 to Examples 9 and 11, it can be seen that maintenance of hydrophilicity of the mixture of monoglyceride and monoglyceride (specifically, the mixture of monoglycerine fatty acid ester and polyglycerine fatty acid ester) is better than that of the mixture of monoglyceride and polyglyceride.

From the comparison of Examples 13 and 14 to Examples 15 to 17, it can be seen that maintenance of hydrophilicity of the mixture of monoglycerine fatty acid ester and polyglycerine fatty acid ester is better than that of monoglycerine fatty acid ester.

From the comparison of Example 17 to Examples 18, 19-1, and 20, it can be seen that when titanium dioxide ($TiO_2$) is used, the carding property is improved even though the same monoglyceride is added in the same amount.

From the comparison of Example 19-1 to Examples 19-4, 19-5, and 19-6, it can be seen that maintenance of the hydrophilicity (the sinking time after the rinsing) and the spinnability become poor as the spinning temperature (temperature of the polymer immediately before the polymer is discharged from the spinneret) is increased. The reason is believed that monoglyceride, which is added to ensure the maintenance of the hydrophilicity, is vaporized according to an increase in spinning temperature to cause a weight loss. Meanwhile, in views of test data of the one-step process of the following Table 4, which includes spinning and stretching continuously performed, the weight of monoglyceride, which is provided during the spinning of the fiber, is reduced when the spinning temperature is 250° C. or more, and the weight loss is significantly increased as the spinning temperature is increased.

In Examples 23 to 26, when the monoglyceride mixture was added in the amount of 5% or more, the spinnability was significantly decreased and the carding workability was poor.

TABLE 4

Test data for the one-step process including spinning and drawing continuously performed (spin speed: 70 mpm)

| | | | | Physical properties of staple fiber | | | | | | | |
|---|---|---|---|---|---|---|---|---|---|---|---|
| Example | Spin temp. (° C.) | Spin speed [mpm] | Spin finish | Spinnability | Shape of cross-section | Tenacity [g/de] | Sinking time [sec] | Sinking time after washing is performed once [sec] | Sinking time after washing is performed twice [sec] | Foaming property [mm] | Carding workability |
| 1-1 | 250 | 70 | E | ◎ | o | 2.72 | 8 | ∞ | ∞ | 0 | Good |
| 1-2 | 250 | 70 | F | ◎ | o | 2.74 | 2 | ∞ | ∞ | 126 | Good |
| 2 | 250 | 70 | E | ◎ | o | 2.76 | 8 | ∞ | ∞ | 0 | Good |

TABLE 4-continued

| Test data for the one-step process including spinning and drawing continuously performed (spin speed: 70 mpm) | | | | | | | | | | | |
|---|---|---|---|---|---|---|---|---|---|---|---|
| | | | | Physical properties of staple fiber | | | | | | | |
| Example | Spin temp. (° C.) | Spin speed [mpm] | Spin finish | Spinnability | Shape of cross-section | Tenacity [g/de] | Sinking time [sec] | Sinking time after washing is performed once [sec] | Sinking time after washing is performed twice [sec] | Foaming property [mm] | Carding workability |
| 3 | 250 | 70 | E | Δ | o | 2.70 | 10 | ∞ | ∞ | 0 | Middle |
| 13 | 250 | 70 | E | ◎ | o | 2.67 | 11 | 24 | 58 | 0 | Middle |
| 14 | 250 | 70 | E | ◎ | o | 2.65 | 10 | 31 | 78 | 0 | Middle |
| 15 | 250 | 70 | E | ◎ | o | 2.68 | 11 | 13 | 30 | 0 | Middle |
| 16 | 250 | 70 | E | ◎ | o | 2.64 | 10 | 18 | 35 | 1 | Middle |
| 17 | 250 | 70 | E | ◎ | o | 2.70 | 10 | 9 | 22 | 1 | Middle |
| 18 | 250 | 70 | E | ◎ | o | 2.72 | 11 | 8 | 22 | 0 | Good |
| 19-1 | 250 | 70 | E | ◎ | o | 2.73 | 10 | 7 | 20 | 1 | Good |
| 19-2 | 260 | 70 | E | Δ | o | 2.58 | 12 | 12 | 31 | 1 | Middle |
| 19-3 | 270 | 70 | E | × | o | — | — | — | — | — | — |
| 20 | 250 | 70 | E | Δ | o | 2.64 | 10 | 7 | 18 | 1 | Good |
| 21 | 250 | 70 | E | × | o | — | — | — | — | — | — |
| 22 | 250 | 70 | E | × | o | — | — | — | — | — | — |
| 25 | 250 | 70 | E | Δ | o | 2.60 | 9 | 5 | 10 | 2 | Poor |
| 26 | 250 | 70 | E | × | o | — | — | — | — | — | — |

The compositions of the above-mentioned Table 2 (the polyolefin resin B was used instead of the polyolefin resin A) were spun under the spinning condition shown in the following Table 4 (spinning temperature and spinning speed) to produce an unstretched yarn of 2.5 denier. The unstretched yarn was stretched at a stretch ratio of 2.2 and a preheating temperature of 60° C. and crimped to 5.5 to 9.0 ea/cm by using the crimper. 10.0 wt % of aqueous emulsion of spin finish E (see Table 1-4) was sprayed thereon to be attached to the surface of the fiber, so that the amount of spin finish was 0.35 wt % based on the total weight of the polyolefin fiber. The spin finish was subjected to thermal fixing at 120° C. and the resulting fiber was cut to lengths of 51 mm to produce a polyolefin fiber having the final fiber fineness of 1.5 denier.

The spinnability, the shape of the section, the tenacity, the fiber sinking time, the sinking time after the rinsing was performed one and two times, the foaming property, and the carding workability of the polyolefin fiber are shown in the following Table 4.

The spinning temperature means the highest temperature immediately before the molten compositions were discharged through the spinneret. The spinnability was obtained by counting the number of yarn breaking and spinning dropping of the fiber under the spinneret. The spinnability was designated by ◎when the number of yarn cutting or spinning drop was less than 1 per unit time, ○ when the number of yarn cutting or spinning drop was in the range of 1 to 3 per unit time, Δ when the number of yarn cutting or spinning drop was more than 3 per unit time, and × when it was impossible to perform the spinning.

The fiber sinking time was obtained according to the ERT (EDANA RECOMMENDED TEST) 10.3-99 method, and the hydrophilicity is good as the sinking time is short. The sinking time was obtained by using the same method as the above-mentioned two-step process comprising the spinning and the stretching separately performed.

Whether curling, fluttering, and static electricity occurs or not and whether formation of webs is desirable or not were checked between card rolls while the fiber passes through the card machine to evaluate the carding workability. When the webs were formed without curling, fluttering, and static electricity, the carding workability was considered to be good. When the curling, the fluttering, and the static electricity occurs and the webs are formed, the carding workability was considered to be fair. When it was impossible to form the webs, the carding workability was considered to be poor.

The amount and the composition of monoglyceride (monoglycerine fatty acid ester and polyglycerine fatty acid ester), which was provided to the fiber, were confirmed by using a liquid chromatography-mass spectrometer (LC/MS), a gas chromatography-mass spectrometer (GC/MS), a Fourier transform infrared (FT-IR) spectroscope, and a Fourier transform nuclear magnetic resonance (FT-NMR) spectroscope. The type, the average particle size, and the amount of titanium dioxide ($TiO_2$) were confirmed by using an X ray diffractometer (XRD) and an inductively coupled plasma mass spectrometer (ICP/MS).

What is claimed is:

1. A polyolefin fiber comprising:

no more than 5 wt % of hydrophilic additive;

no more than 3 wt % of titanium dioxide (TiO2); and no more than 1 wt % of spin finish provided over a surface thereof, wherein the spin finish comprises:

(i) 70 to 85 wt % of one or more non-ionic surfactants selected from the group consisting of polyethylene polypropylene glycol monobutyl ether, polyoxyethylene sorbitan trioleate, and polyoxyethylene ester oleate;

(ii) 5 to 15 wt % of anion antistatic agents including polyoxyethylene alkyl phosphate which contains an alkyl group having 8 to 18 carbon atoms and of which phosphate is one or more selected from the group consisting of a sodium salt, a potassium salt, a triethylamine salt, and a monoethylamine salt; and (iii) 5 to 15 wt % of one or more non-silicon antifoaming agents selected from the group consisting of polyoxyalkylene glycol, poly (oxyethylene, oxypropylene) alkyl ether, poly (oxyethylene, oxypropylene) glycol copolymer, and polyoxyalkylene triol.

2. A polyolefin fiber comprising:

no more than 5 wt % of hydrophilic additive; and no more than 3 wt % of titanium dioxide (TiO2), wherein the polyolefin comprises at least 0.2 wt % of hydrophilic additive, and at least 0.05 wt % of titanium dioxide (TiO2), and at least 0.2 wt % of spin finish, and wherein the hydrophilic additive includes monoglycerine fatty acid ester containing monoglyceride represented by Formula 1 and polyglycerine fatty acid ester containing monoglyceride represented by Formula 2 at a mixing ratio of 10:90 to 90:10:

[Formula 1]

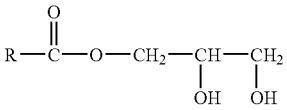

[Formula 2]

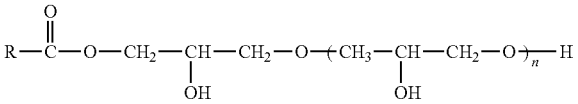

wherein, R is each independently saturated or unsaturated hydrocarbon having 10 to 18 carbon atoms and n is an integer in the range of 1 to 9.

3. The polyolefin fiber according to claim 2, wherein the monoglycerin fatty acid ester is one or more selected from the group consisting of glycerine monocaprate, glycerine monolaurate, glycerin monomyristate, glycerin monopalmitate, glycerin monostearate, and glycerin monooleate, and the polyglycerine fatty acid ester is one or more selected from the group consisting of diglycerin monocaprate, diglycerin monolaurate, diglycerin monomyristate, diglycerin monopalmitate, diglycerin monostearate, and diglycerin monooleate.

4. A polyolefin fiber comprising:

no more than 5 wt % of hydrophilic additive; and no more than 3 wt % of titanium dioxide (TiO2), wherein the hydrophilic additive includes monoglycerine fatty acid ester containing monoglyceride represented by Formula 1 and polyglycerine fatty acid ester containing monoglyceride represented by Formula 2 at a mixing ratio of 10:90 to 90:10:

[Formula 1]

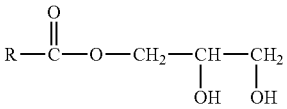

-continued

[Formula 2]

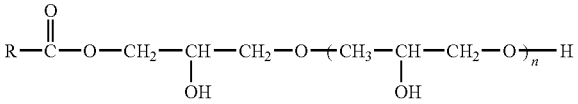

wherein, R is each independently saturated or unsaturated hydrocarbon having 10 to 18 carbon atoms and n is an integer in the range of 1 to 9.

5. The polyolefin fiber according to claim 4, wherein the monoglycerin fatty acid ester is one or more selected from the group consisting of glycerine monocaprate, glycerine monolaurate, glycerin monomyristate, glycerin monopalmitate, glycerin monostearate, and glycerin monooleate, and the polyglycerine fatty acid ester is one or more selected from the group consisting of diglycerin monocaprate, diglycerin monolaurate, diglycerin monomyristate, diglycerin monopalmitate, diglycerin monostearate, and diglycerin monooleate.

6. The polyolefin fiber according to claim 4, wherein the titanium dioxide is selected from rutile titanium dioxide, anatase titanium dioxide, and brookite titanium dioxide which have a refractive index of 2 or more.

7. The polyolefin fiber according to claim 4, wherein the titanium dioxide is anatase titanium dioxide having an average particle size of 0.4 μm or less.

8. The polyolefin fiber according to claim 4, wherein the polyolefin fiber has a fineness of 5.0 deniers or less.

9. The polyolefin fiber according to claim 4, wherein the polyolefin is polypropylene.

10. The polyolefin fiber according to claim 2, wherein the titanium dioxide is selected from rutile titanium dioxide, anatase titanium dioxide, and brookite titanium dioxide which have a refractive index of 2 or more.

11. The polyolefin fiber according to claim 2, wherein the titanium dioxide is anatase titanium dioxide having an average particle size of 0.4 μm or less.

12. The polyolefin fiber according to claim 2, wherein the polyolefin fiber has a fineness of 5.0 deniers or less.

13. The polyolefin fiber according to claim 2, wherein the polyolefin is polypropylene.

14. A non-woven fabric produced by using the polyolefin fiber according to claim 4.

15. The polyolefin fiber according to claim 2, wherein polyolefin comprises at least 0.2 wt % of hydrophilic additive, and at least 0.05 wt % of titanium dioxide (TiO2), and at least 0.2 wt % and no more than 1 wt % of spin finish.

16. The polyolefin fiber according to claim 2, wherein the polyolefin fiber is spun to have a circular section, a modified cross-section including an X-shaped section, a Y-shaped section, a deltaic section, an oval section, a diamond section, a bladebone-shaped section, or a combined section thereof.

17. The polyolefin fiber according to claim 4, wherein the polyolefin fiber is spun to have a circular section, a modified cross-section including an X-shaped section, a Y-shaped section, a deltaic section, an oval section, a diamond section, a bladebone-shaped section, or a combined section thereof.

* * * * *